US009814326B2

(12) United States Patent
Choueifati et al.

(10) Patent No.: US 9,814,326 B2
(45) Date of Patent: Nov. 14, 2017

(54) REFRIGERATION SYSTEM HAVING A COMMON AIR PLENUM

(71) Applicant: Hill Phoenix, Inc., Conyers, GA (US)

(72) Inventors: Jules G. Choueifati, Richmond, VA (US); Larry C. Howington, Chesterfield, VA (US); Timothy D. Swofford, Midlothian, VA (US)

(73) Assignee: Hill Phoenix, Inc., Conyers, GA (US)

( * ) Notice: Subject to any disclaimer, the term of this patent is extended or adjusted under 35 U.S.C. 154(b) by 425 days.

(21) Appl. No.: 14/469,470

(22) Filed: Aug. 26, 2014

(65) Prior Publication Data

US 2016/0058207 A1 Mar. 3, 2016

(51) Int. Cl.

| | |
|---|---|
| ***A47F 3/04*** | (2006.01) |
| ***F25B 5/02*** | (2006.01) |
| ***F25D 15/00*** | (2006.01) |
| *F25D 11/02* | (2006.01) |
| *F25D 23/02* | (2006.01) |

(52) U.S. Cl.

CPC ..... *A47F 3/0447* (2013.01); *F25B 5/02* (2013.01); *F25D 15/00* (2013.01); *A47F 3/0452* (2013.01); *F25B 2400/06* (2013.01); *F25D 11/025* (2013.01); *F25D 23/023* (2013.01)

(58) Field of Classification Search

CPC .... F25D 11/025; F25D 23/023; A47F 3/0447; A47F 3/0452

USPC ..... 62/255–256

See application file for complete search history.

(56) References Cited

U.S. PATENT DOCUMENTS

| | | | | | |
|---|---|---|---|---|---|
| 3,850,003 | A * | 11/1974 | Beckwith | F25D 21/125 | 62/256 |
| 5,448,896 | A * | 9/1995 | Rushing | F25D 15/00 | 62/255 |
| 5,743,098 | A * | 4/1998 | Behr | A47F 3/0408 | 62/199 |
| 5,924,297 | A * | 7/1999 | Wolff | A47F 3/0456 | 62/152 |
| 6,145,327 | A * | 11/2000 | Navarro | A47F 3/001 | 62/256 |
| RE37,630 | E | 4/2002 | Behr | | |
| 7,318,321 | B2 * | 1/2008 | Grassmuck | A47F 3/0447 | 312/116 |
| 2003/0084675 | A1 * | 5/2003 | Thurman | A47F 3/0404 | 62/246 |
| 2003/0084676 | A1 * | 5/2003 | Thurman | A47F 3/0404 | 62/256 |
| 2005/0076662 | A1 * | 4/2005 | Roche | A47F 3/0447 | 62/246 |
| 2005/0126196 | A1 * | 6/2005 | Grassmuck | A47F 3/0482 | 62/251 |

(Continued)

*Primary Examiner* — Paul R Durand
*Assistant Examiner* — Andrew P Bainbridge
(74) *Attorney, Agent, or Firm* — Foley & Lardner LLP

(57) ABSTRACT

An air cooling system for a temperature-controlled display case includes at least two modular cooling elements, one or more fans configured to provide an air flow to the at least two modular cooling elements, and an air plenum common to each of the one or more fans and the at least two modular cooling elements, the air plenum being configured to direct the air flow from the one or more fans through the at least two modular cooling elements and into a product area of the temperature-controlled display case.

20 Claims, 7 Drawing Sheets

(56) References Cited

U.S. PATENT DOCUMENTS

| | | | | |
|---|---|---|---|---|
| 2009/0215381 | A1* | 8/2009 | Swofford | A47F 3/0447 454/193 |
| 2010/0212343 | A1* | 8/2010 | Swofford | A47F 3/0447 62/248 |
| 2011/0271701 | A1* | 11/2011 | Stephens | A47F 3/0491 62/255 |
| 2015/0257549 | A1 | 9/2015 | Shaprio et al. | |
| 2016/0058207 | A1* | 3/2016 | Choueifati | A47F 3/0447 62/256 |

* cited by examiner

REFRIGERATION SYSTEM HAVING A COMMON AIR PLENUM

FIELD

The present disclosure relates generally to the field of temperature-controlled display devices (e.g., refrigerated display cases) having a temperature-controlled space for storing and displaying products such as refrigerated foods or other perishable objects. More specifically, the present disclosure relates to a refrigerated display case having a common air plenum for delivering chilled air.

BACKGROUND

It is well known to provide a temperature-controlled display device (e.g., a refrigerator, freezer, refrigerated merchandiser, refrigerated display case, etc.) that may be used in commercial, institutional, and residential applications for storing or displaying refrigerated or frozen objects. For example, it is known to provide service type refrigerated display cases for displaying fresh food products (e.g., beef, pork, poultry, fish, etc.) in a supermarket or other commercial setting.

Such refrigerated cases typically include cooling elements (e.g. cooling coils, heat exchangers, evaporators, etc.) that receive a coolant (e.g. a liquid such as a glycol-water mixture, a refrigerant, etc.) from a condensing system (e.g., condensing unit, heat transfer device, heat exchanger, condenser, etc.) during a cooling mode or operation to provide cooling to the temperature-controlled space. For instance, the coolant at the cooling element may absorb heat from the air surrounding the cooling element, chilling the surrounding air, and one or more fans may be used to direct the chilled air into the temperature-controlled space.

Often, the temperature-controlled display device may require more than one cooling element in order to cool a temperature-controlled space. For instance, regulations may exist that restrict the use of a particular refrigerant type used in a single cooling element and condensing unit loop. In these instances, it would be advantageous to provide a plurality of modular heat exchange systems in a temperature-controlled display device having a common air supply plenum and one or more fans to provide a common air supply to all modular heat exchange systems, where each modular heat exchange system has a condensing unit supplying coolant to a cooling element.

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

SUMMARY

One implementation of the present disclosure is an air cooling system for a temperature-controlled display case. The air cooling system includes at least two modular cooling elements, one or more fans configured to provide an air flow to the at least two modular cooling elements, and an air plenum common to each of the one or more fans and the at least two modular cooling elements, the air plenum being configured to direct the air flow from the one or more fans through the at least two modular cooling elements and into a product area of the temperature-controlled display case.

Another implementation of the present disclosure is a temperature-controlled display case. The display case includes a product display area, and an air cooling system configured to provide cooled air to the product display area. The air cooling system includes at least two modular cooling elements, one or more fans configured to provide an air flow to the at least two modular cooling elements, and an air plenum common to each of the one or more fans and the at least two modular cooling elements, the air plenum being configured to circulate the air flow from the one or more fans through the at least two modular cooling elements and into the product display area.

Another implementation of the present disclosure is an air cooling system for a temperature-controlled display case. The air cooling system includes an evaporator, a condensing system having a plurality of fluid circuits routed through the evaporator and being configured to provide an inlet supply of coolant through the evaporator via the plurality of fluid circuits, one or more fans configured to provide an air flow to the plurality of fluid circuits, and an air plenum common to each of the one or more fans and the plurality of fluid circuits, the air plenum being configured to circulate the air flow from the one or more fans over the plurality of fluid circuits and into a product display area of the temperature-controlled display case.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
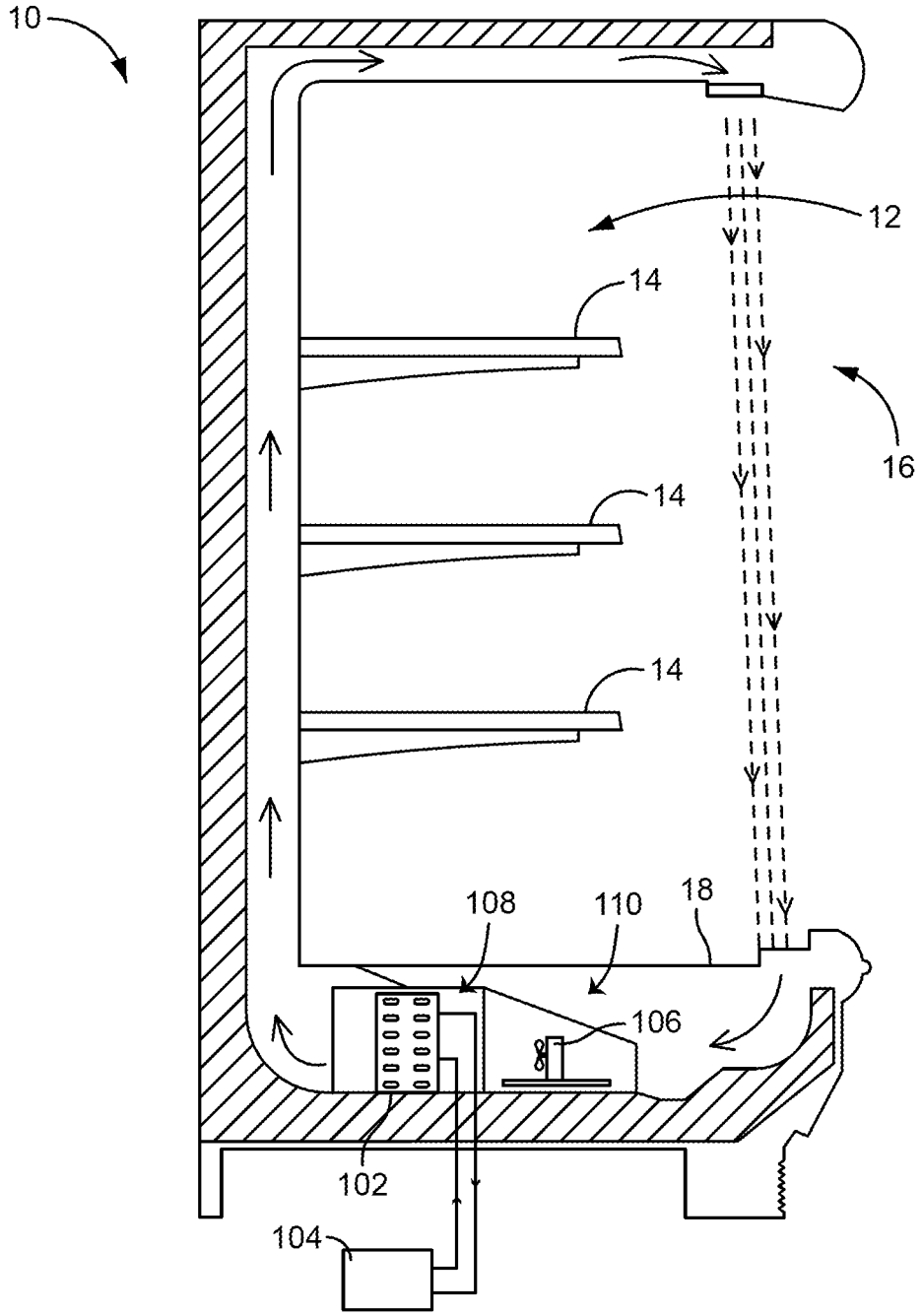
FIG. 1 is a schematic illustration of a temperature-controlled display device having an air cooling system, according to an exemplary embodiment.

Referring generally to the FIGURES, an air cooling system is shown, according to an exemplary embodiment. The air cooling system described herein may be implemented in conjunction with a temperature-controlled display device (e.g., a refrigerator, freezer, refrigerated merchandiser, refrigerated display case, etc.) to provide chilled air to a display area of the display device.

The air cooling system may include one or more modular heat exchange systems, each including a condensing unit (e.g., heat transfer device, heat exchanger, condenser, etc.) connected to a cooling element (e.g. evaporator, cooling coil, fan-coil, evaporator coil, heat exchanger, etc.). The condensing unit is configured to route liquid coolant to the cooling element, such that the cooling element absorbs heat from the air surrounding the cooling element, providing chilled air. The air cooling system also includes a plurality of fans configured to drive air through an air plenum common to the air cooling system and all cooling elements, such that the chilled air is driven into a product area of the associated display device.

In a direct exchange system, the condensing unit includes a condenser or similar heat transfer device configured to condense coolant vapor into liquid form. The condensing unit may route the liquid coolant from the condenser through a connected cooling element. At the cooling element, the liquid coolant absorbs heat from the air surrounding the cooling element in order to chill the surrounding air, which may cause the coolant to be converted to a vapor or gas. The chilled air may then be driven through the common air plenum to the product area of the associated display device, while the cooling element delivers the coolant vapor back to the condensing unit. The condensing unit may include a condenser configured to receive the coolant vapor from the cooling element, compress the coolant vapor (e.g., increase the pressure and/or temperature of the coolant vapor), and send the superheated coolant back to the condenser to be cooled and converted back to liquid form.

In a secondary coolant exchange system, the condensing unit forms an at least semi-closed loop for a primary coolant. The condenser of the condensing unit condenses the primary coolant vapor into liquid form, and the liquid primary coolant is routed to a heat exchange (e.g., evaporating) portion of the condensing unit where heat may be exchanged between the condensing unit and the cooling element. At the heat exchange portion, the primary coolant absorbs heat from a secondary coolant of the cooling element in order to chill the secondary coolant, which may cause the primary coolant to be converted to a vapor or gas. The chilled secondary coolant may then be used to similarly absorb heat from the air surrounding the cooling element in order to chill the surrounding air. The chilled air may then be driven through a common air plenum to the product area of the associated display device. Once the secondary coolant is heated by the air surrounding the cooling element, the heated secondary coolant may be routed back to the heat exchange portion. The primary coolant, which had been converted to vapor, is routed to a compressor and then a condenser of the condensing unit to cool the primary coolant and convert back to liquid form, and then is routed to the heat exchange portion to again cool the secondary coolant of the cooling element.

Figure 2:
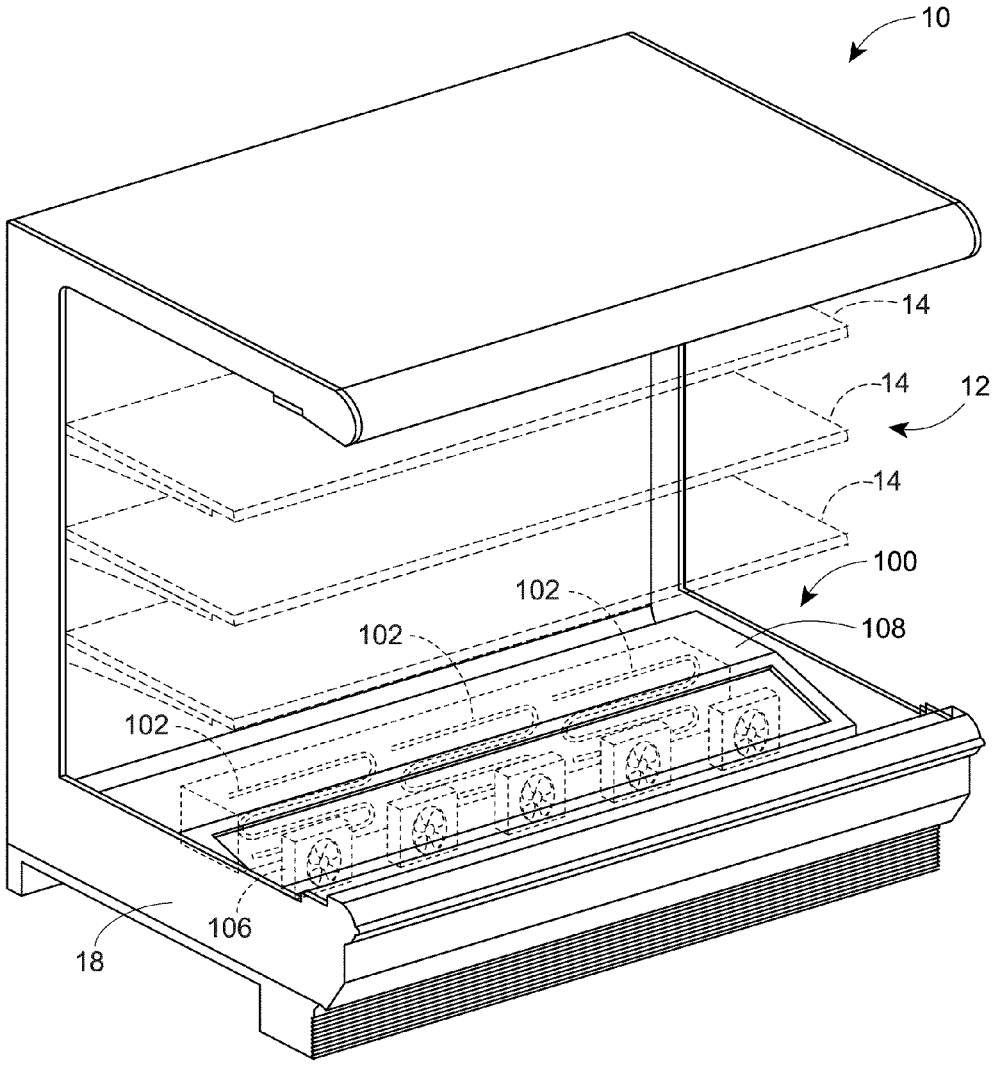
FIG. 2 is a perspective view of a temperature-controlled display device having an air cooling system with a common air plenum, according to an exemplary embodiment.

Referring now to FIGS. 1 and 2, a temperature-controlled display device 10 is shown, according to an exemplary embodiment. Temperature controlled-display device 10 may be a refrigerator, a freezer, a refrigerated merchandiser, a refrigerated display case, or other device capable of use in a commercial, institutional, or residential setting for storing and/or displaying refrigerated or frozen objects. For example, temperature-controlled display device 10 may be a service type refrigerated display case for displaying fresh food products (e.g., beef, pork, poultry, fish, etc.) in a supermarket or other commercial setting.

Temperature-controlled display device 10 is shown to include a temperature-controlled space 12 having a plurality of shelves 14 for storage and display of products therein. In various embodiments, temperature-controlled display device 10 may be an open-front refrigerated display case (as shown in FIGS. 1 and 2) or a closed-front display case. An open-front display case may use a flow of chilled air that is discharged across the open front of the case (e.g., forming an air curtain 16) to help maintain a desired temperature within temperature-controlled space 12. A closed-front display case may include one or more doors for accessing food products or other items stored within temperature-controlled space 12. Both types of display cases may also include various openings within temperature-controlled space 12 that are configured to route chilled air from a cooling element 102 to other portions of the respective display case.

Temperature-controlled display device 10 is shown to include a cooling system 100 for cooling temperature-controlled space 12. Cooling system 100 may utilize a direct heat exchange system in the illustrated embodiment of FIG. 1, but in other embodiments may include a secondary coolant exchange system or another type of heat exchange system. Cooling system 100 includes at least one cooling element 102 (e.g. evaporator, cooling coil, fan-coil, evaporator coil, heat exchanger, etc.). In the cooling mode of operation, cooling element 102 may operate at a temperature lower than the temperature of the air within temperature-controlled space 12 to provide cooling to temperature-controlled space 12. For instance, during the cooling mode, cooling element 102 may receive a liquid coolant (e.g., a secondary coolant) from condensing unit 104 (e.g., heat transfer device, heat exchanger, condenser, condensing system, etc.). The liquid coolant may lower the temperature of cooling element 102 below the temperature of the air surrounding cooling element 102, causing the cooling element 102 (e.g., the liquid coolant within cooling element 102) to absorb heat from the surrounding air. As the heat is removed from the surrounding air, the surrounding air is chilled. The chilled air may then be directed to temperature-controlled space 12 by at least one fan 106 (or another air flow device) in order to lower or otherwise control the temperature of temperature-controlled space 12.

In an exemplary embodiment, cooling system 100 includes a plurality of cooling elements 102 configured to receive air driven by a plurality of fans 106, wherein cooling elements 102 and fans 106 are housed within a common air plenum 108 (e.g., chamber, compartment, space, channel, etc.). When air is driven through common plenum 108 by fans 106, the chilled air surrounding cooling element 102 is forced into temperature-controlled space 12 in order to cool or otherwise control the temperature of temperature-controlled space 12. Common air plenum 108 may be shaped or otherwise configured to drive the chilled air surrounding cooling elements 102 into temperature-controlled space 12. For instance, common air plenum 108 may decrease in volume from the position of fans 106 to cooling elements 102, or as the air from fans 106 is driven toward cooling elements 102.

As heat is absorbed by the liquid coolant within cooling element 102, the coolant may be converted to a vapor state. Condensing unit 104 may include a compressor configured to pull or draw the coolant vapor from cooling element 102. Condensing unit 104 may compress (e.g., superheat, heat, pressurize, etc.), the coolant vapor at the compressor and route the coolant vapor to a condensing or heat exchange section of condensing unit 104 in a superheated hot gas state. In other embodiments, cooling system 100 may include a separate compressor configured to draw the coolant vapor from cooling element 102 and discharge the coolant vapor to condensing unit 104 in a superheated hot gas state. Once the hot gas coolant has been compressed, condensing unit 104 may condense the hot gas coolant into a liquid state by lowering the temperature of the coolant. Cooling system 100 may also include a fan or other air flow element configured to blow air across or into condensing unit 104 in order to remove heat from the coolant and condense the coolant into a liquid state. The fan may also be included as part of condensing unit 104. Condensing unit 104 may then route the liquid coolant back to cooling element 102 in order to absorb heat from the air surrounding cooling element 102 and provide additional chilled air for temperature-controlled space 12.

Temperature-controlled display device 10 is shown to include a compartment 18 located beneath the cooling element 102 and the temperature-controlled space 12. In various embodiments, compartment 18 may be located beneath temperature-controlled space 12, behind temperature-controlled space 12, above temperature-controlled space 12, or otherwise located with respect to temperature-controlled space 12. Compartment 18 may contain components of cooling system 100 such as condensing unit 104. In some embodiments, cooling system 100 includes one or more additional components such as a separate compressor, an expansion device (e.g., to expand the condensed refrigerant to a low pressure, low temperature state for use by cooling element 102), a valve or other pressure-regulating device, a temperature sensor, a controller, a fan, and/or other components commonly used in refrigeration systems, any of which may be stored within compartment 18.

Figure 3:
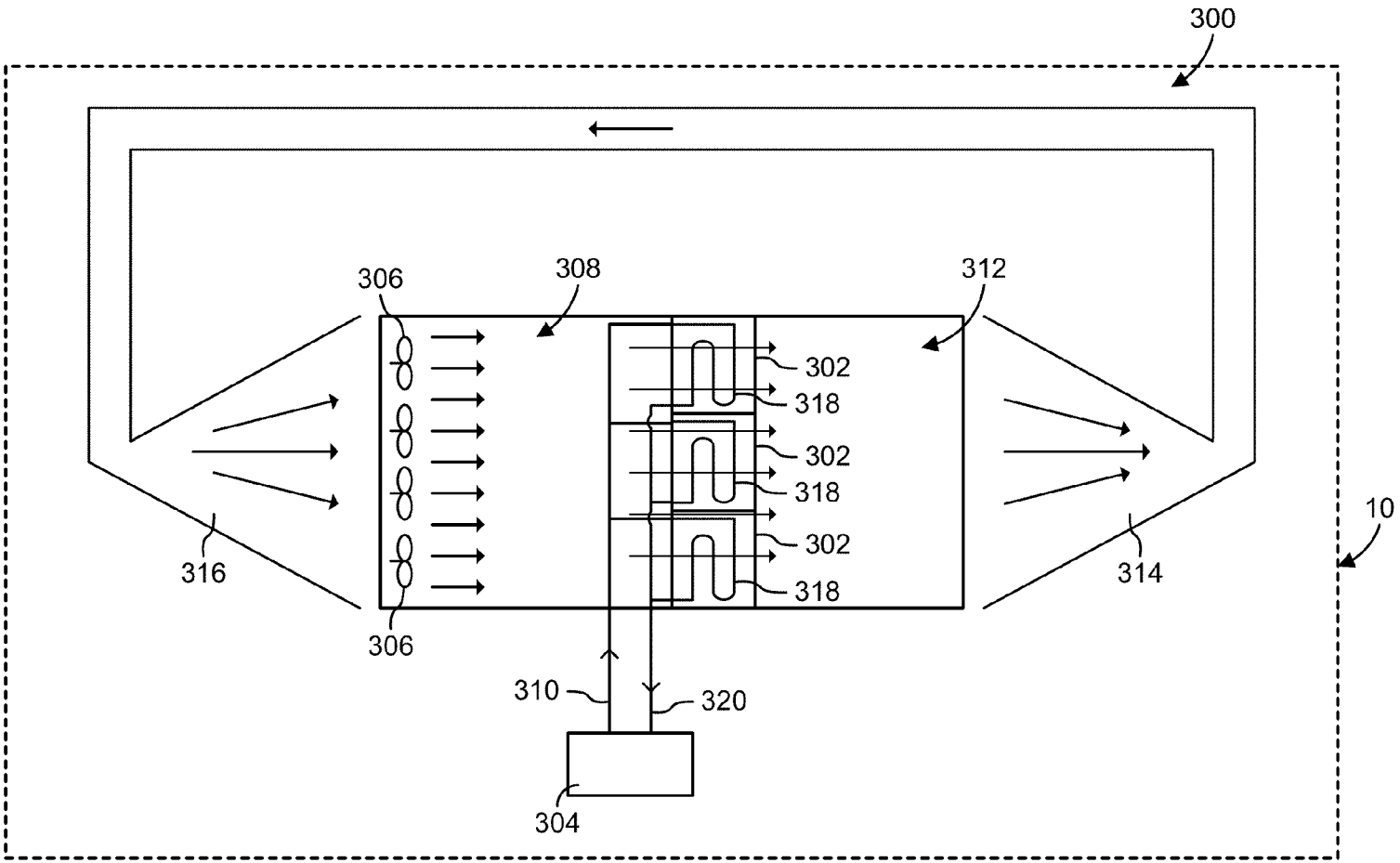
FIG. 3 is a schematic illustration of an air cooling system for the temperature-controlled display case, according to an exemplary embodiment in which the air cooling system includes modular evaporators and a local condensing unit.
Figure 4:
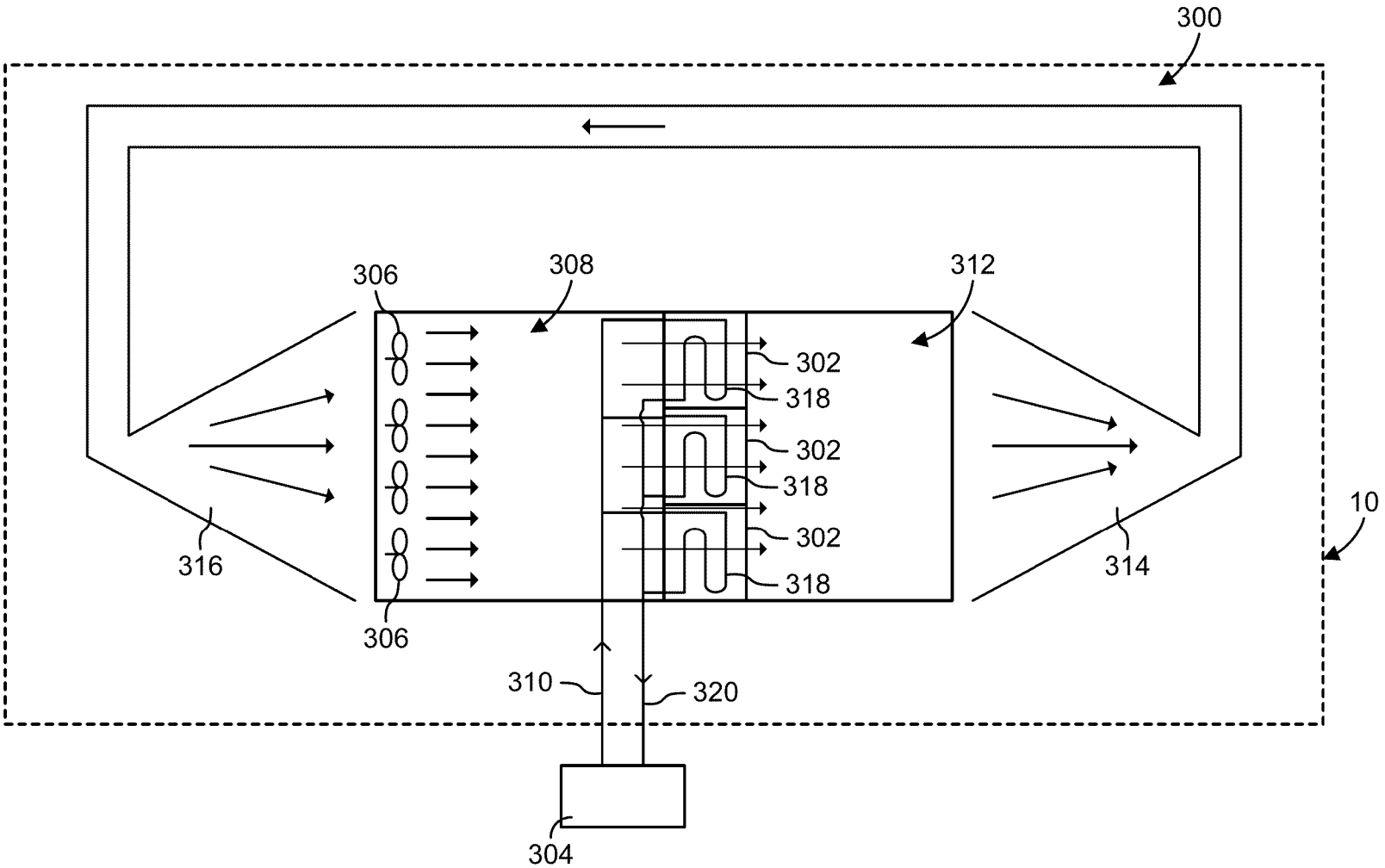
FIG. 4 is a schematic illustration of an air cooling system for the temperature-controlled display case, according to an exemplary embodiment in which the air cooling system includes modular evaporators and a remote condensing unit.

Referring now to FIGS. 3 and 4, cooling system 300 is shown, according to an exemplary embodiment. Cooling system 300 is similar to cooling system 100 shown in FIGS. 1 and 2, and any description of cooling system 100 or any of its components may apply accordingly to cooling system 300. Cooling system 300 may be used to cool or otherwise control the temperature of display device 10. Cooling system 300 is a direct heat exchange system, including a plurality of cooling elements 302 configured to receive liquid coolant from a connected condensing unit 304. In the illustrated embodiment of FIG. 3, condensing unit 304 is contained within display device 10 or is otherwise local to display device 10. For instance, condensing unit 304 may be stored within compartment 18 (shown in FIG. 1). In the illustrated embodiment of FIG. 4, condensing unit 304 is remotely connected to cooling elements 302 and configured to supply liquid coolant remotely.

Each cooling element 302 includes a coil 318 (e.g., an evaporator coil) configured to receive liquid coolant from a connected condensing unit 304. The condensing unit 304 is connected to coils 318 by an inlet fluid line 310 configured to deliver liquid coolant to each coil 318 in parallel. In one embodiment, fluid line 310 is a single fluid line configured to deliver liquid coolant from condensing unit 304 to each coil 318. In another embodiment, condensing unit is connected to coils 318 by more than one fluid line 310, such as having a single fluid line 310 connected to each coil 318. Cooling elements 302 are configured to store the liquid coolant within the coils 318 for a period of time. The liquid coolant may be used to cool cooling elements 302 (e.g., coils 318) in order to absorb heat from the air surrounding cooling elements 302 and chill the surrounding air. As the heat is absorbed by the coolant within coils 318 (i.e., chilling the surrounding air), the coolant may be heated to a vapor state. The heated coolant vapor may then be returned to the condensing unit 304 or to a separate compressor (not shown) via a discharge line 320 so that the coolant vapor may be compressed, condensed to a liquid form, and re-used at cooling elements 302.

Still referring to FIGS. 3 and 4, cooling system 300 is shown to include one or more fans 306 (e.g., fan motors) or other air moving devices configured to provide an air flow to coils 318. The air flow provided by fans 306 forces the chilled air surrounding coils 318 into a product area 312 (i.e., product cooling zone) of display device 10, cooling the products stored within product area 312. In an exemplary embodiment, cooling system 300 includes a plurality of fans 306 configured to drive air through a single air plenum 308 (e.g., chamber, space, channel, passage, etc.) that is common to fans 306 and cooling elements 302 of cooling system 300. For instance, fans 306 and cooling elements 302 may be positioned within air plenum 308 such that air directed by fans 306 is forced through common air plenum 308 to reach cooling elements 302 (e.g., coils 318), or so that any chilled air received by product area 312 is received via air plenum 308. From product area 312, air may travel to a return duct 314 and then reach a supply duct 316 of cooling system 300. Supply duct 316 is configured to supply air to an inlet of fans 306, such that an air circuit is formed.

Fans 306 and cooling elements 302 may be arranged similarly such that each cooling element 302 receives a substantially similar amount of air flow from fans 306. For instance, cooling system 300 may include an identical number of fans 306 and cooling elements 302 (or coils 318), with each fan 306 corresponding to a single cooling element 302 (or coil 318). In one embodiment, fans 306 and cooling elements 302 are arranged in parallel across a width or length of the air plenum 308. For instance, fans 306 and/or cooling elements 302 may be arranged within air plenum 308 to extend from a first side of air plenum 308 to an opposite side of air plenum 308. In another embodiment, fans 306 and cooling elements 302 may be similarly stacked within air plenum 308, such as extending from a top side to a bottom side of air plenum 308.

Air plenum 308 may be shaped or otherwise configured in order to direct or otherwise manipulate the air flow through air plenum 308. In some embodiments, air plenum 308 may have a non-uniform shape in order to direct air toward a specific cooling element 302, or toward a section of air plenum 308 housing one or more cooling elements 302. For instance, cooling elements 302 may be non-uniform in shape or size such that greater air flow is directed toward a cooling element 302 with greater cooling capabilities. In one embodiment, a width or volume of air plenum 308 may decrease along the air path from fans 306 to cooling elements 302 (or toward a specific cooling element 302), such that the velocity of the air flow may be increased as the air reaches the cooling elements 302.

Although in the illustrated embodiments cooling system 300 is shown to include three (3) cooling elements 302, in other embodiments cooling system 300 may include a greater or lesser number of cooling elements 302 depending on the particular requirements of cooling system 300 and/or display device 10. For instance, a larger display device 10 or a display device 10 facilitating a product having a lower required temperature may require more cooling elements 302 to provide sufficient cooling. The cooling system 300 may also include a greater or lesser number of cooling elements 302 depending on the various rules or regulations related to the type of coolant used to cool display device 10. Likewise, cooling system 300 includes four fans 306 configured to deliver a common air flow through coils 318, but cooling system 300 may include a greater or less number of fans 306 in other embodiments depending on the particular requirements of display device 10. For instance, the number of fans 306 used to chill product area 312 may be dependent on the size or number of cooling elements 302 within cooling system 300.

Figure 5:
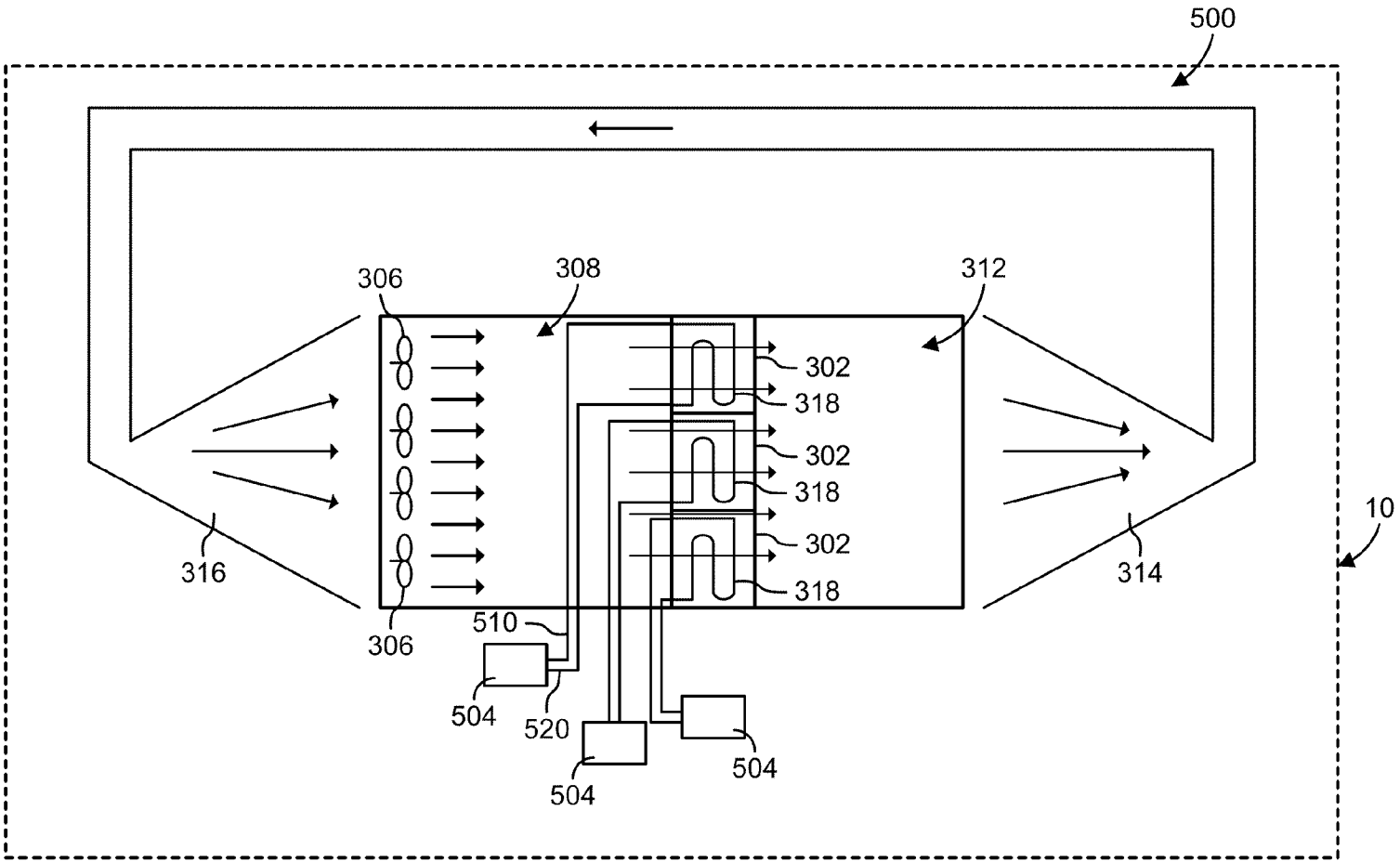
FIG. 5 is a schematic illustration of an air cooling system for the temperature-controlled display case, according to an exemplary embodiment in which the air cooling system includes modular heat exchange units.

Referring now to FIG. 5, a cooling system 500 for controlling the temperature of display device 10 is shown, according to an exemplary embodiment. Cooling system 500 is similar to cooling systems 100 and 300, but cooling system 500 includes a plurality of condensing units 504 configured to supply coolant to cooling elements 302. In the illustrated embodiment of FIG. 5, condensing units 504 are contained within display device 10 or are otherwise local to display device 10. In other embodiments, however, condensing units 504 may be remotely connected to cooling elements 302 and configured to supply liquid coolant remotely.

In the illustrated embodiment of FIG. 5, each of the plurality of condensing units 504 is uniquely associated with one and only one of cooling elements 302. Each of condensing units 504 is configured to provide a supply of liquid coolant to one of cooling elements 302 via a supply line 510. The liquid coolant is stored within associated coil 318 in order to absorb heat from the air surrounding coil 318. The coolant may then be returned to condensing unit 504 in vapor form via a discharge line 520. In this way, each of condensing units 504 may form a modular heat exchange system with its associated cooling element 302, such that cooling system 500 includes three separate modular heat exchange systems comprising cooling element 302 connected to and receiving liquid coolant from a separate condensing unit 504. In other embodiments, cooling system 500 may include more or fewer modular heat exchange systems, depending on the cooling requirements of display device 10 and/or regulations or requirements related to the modular heat exchange systems and/or the liquid coolant.

Similar to cooling system 300, cooling system 500 also includes single air plenum 308 common to each of one or more fans 306 and cooling elements 302. Air plenum 308 is configured to direct air flow from the one or more fans 306 over coils 318 and into product area 312 of temperature-controlled display device 10, such that each of coils 318 receives air from common air plenum 308.

Figure 6:
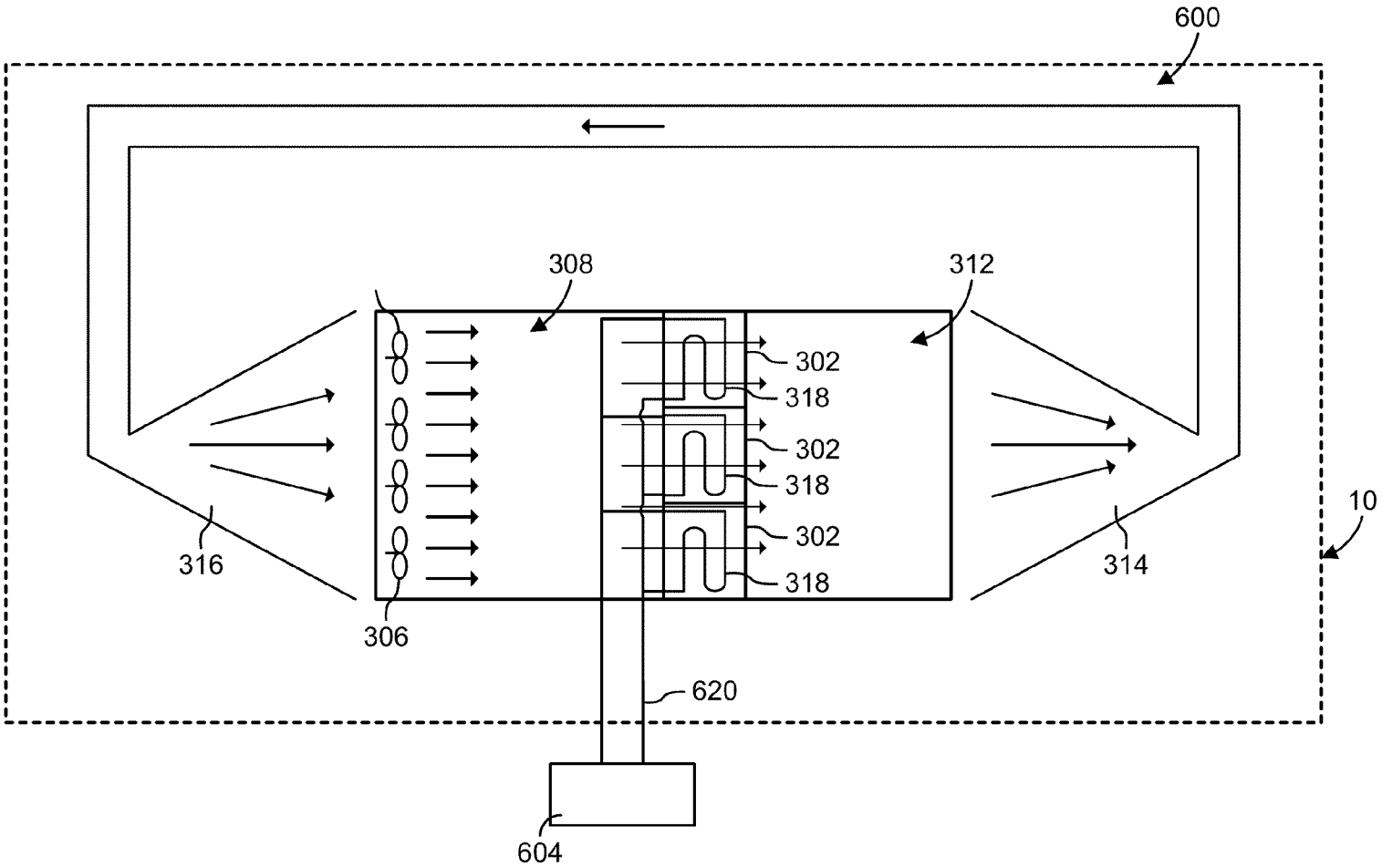
FIG. 6 is a schematic illustration of an air cooling system for the temperature-controlled display case, according to an exemplary embodiment in which the air cooling system includes modular cooling elements connected to a remote chiller.

Referring now to FIG. 6, cooling system 600 is shown, according to an exemplary embodiment. Cooling system 600 may be used to cool or otherwise control the temperature of display device 10. Cooling system 600 is similar to cooling systems 100 and 300, and any description of cooling systems 100 and 300 or any of their components may apply accordingly to cooling system 600. However, while cooling systems 100 and 300 utilize direct heat exchange systems, cooling system 600 is shown to include a secondary heat exchange system (i.e., a chiller 604), which may be located remotely, in order to provide coolant to the cooling elements of cooling system 600, which may be located remotely.

Cooling system 600 is shown to include chiller 604, which may operate similarly to one of the previously described condensing units (e.g., condensing units 104, 304) to provide coolant for cooling system 600. In an exemplary embodiment, chiller 604 includes an at least semi-closed heat exchange loop (i.e., a primary heat exchange loop) that is internal to chiller 604 (not shown). This primary heat exchange loop includes a primary coolant that may be used to chill (i.e., cool) a secondary coolant for routing external to chiller 604. In the illustrated embodiment, the secondary coolant is routed to cooling elements 602 (e.g., coils 618) from chiller 604 via fluid lines 620 as part of a secondary heat exchange loop. The secondary coolant is utilized at cooling elements 602 to chill (i.e., absorb heat from) the air surrounding cooling elements 602, providing a supply of chilled air for product area 312.

Like cooling systems 100, 300, and 400, cooling system 600 includes fans 306 configured to drive air through air plenum 308. Fans 306 force the chilled air surrounding cooling elements 602 into product area 312. Air plenum 308 may be common to all fans 306 and cooling elements 302 of cooling system 600. For instance, fans 306 and cooling elements 602 may be positioned within air plenum 308 such that air directed by fans 306 is forced through common air plenum 308 to reach cooling elements 602 (e.g., coils 618), or such that any chilled air received by product area 312 is received via air plenum 308.

As the heat is absorbed from the air surrounding cooling elements 602, the secondary coolant (e.g., within coils 618) may become heated or warmed. The warmed secondary coolant is then routed to chiller 604 so that the secondary coolant may be chilled and re-used. In an exemplary embodiment, the secondary coolant remains in a liquid state as the secondary coolant is heated and chilled (i.e., throughout the secondary heat exchange loop). However, in other embodiments, the secondary coolant may be heated to a vapor or gaseous state and chilled to a liquid state at chiller 604 (e.g., by primary coolant). In one embodiment, the secondary coolant is routed to chiller 604 once the secondary coolant is no longer useable to sufficiently to chill the air surrounding cooling elements 602. Chiller 604 includes a heat exchange portion wherein the primary heat exchange loop interacts with the secondary heat exchange loop, such that the primary coolant absorbs heat from the secondary coolant, chilling the secondary coolant for re-use in cooling product area 312.

The primary heat exchange loop of chiller 604 (not shown) may be similar to the direct heat exchange loop utilized by condensing units 104 and 304. When the primary coolant is used to absorb heat from and chill the secondary coolant, the primary coolant may be heated to a vapor state. In one embodiment, chiller 604 includes a condenser (not shown) configured to condense (e.g., cool) the primary coolant vapor into a liquid state as part of the primary heat exchange system. The liquid primary coolant may then be routed to the heat exchange (e.g., evaporating) portion of chiller 604 that is configured to interact (e.g., exchange heat) with the secondary coolant utilized by cooling elements 602. For instance, a heated or warmed secondary coolant may be routed to chiller 604 by cooling elements 602 via fluid line 620. Chiller 604 may be configured to cool the secondary coolant by utilizing the primary coolant to absorb heat from the secondary coolant (e.g., via evaporation). As the primary coolant absorbs heat from the secondary coolant, the primary coolant may be converted to a vapor or gas. The primary coolant vapor may then be routed to a compressor and then a condenser of chiller 604 to cool the primary coolant and convert back to a cooled liquid state. The primary coolant is then routed to the heat exchange portion of chiller 604 to again cool the secondary coolant for use in cooling product area 312.

Figure 7:
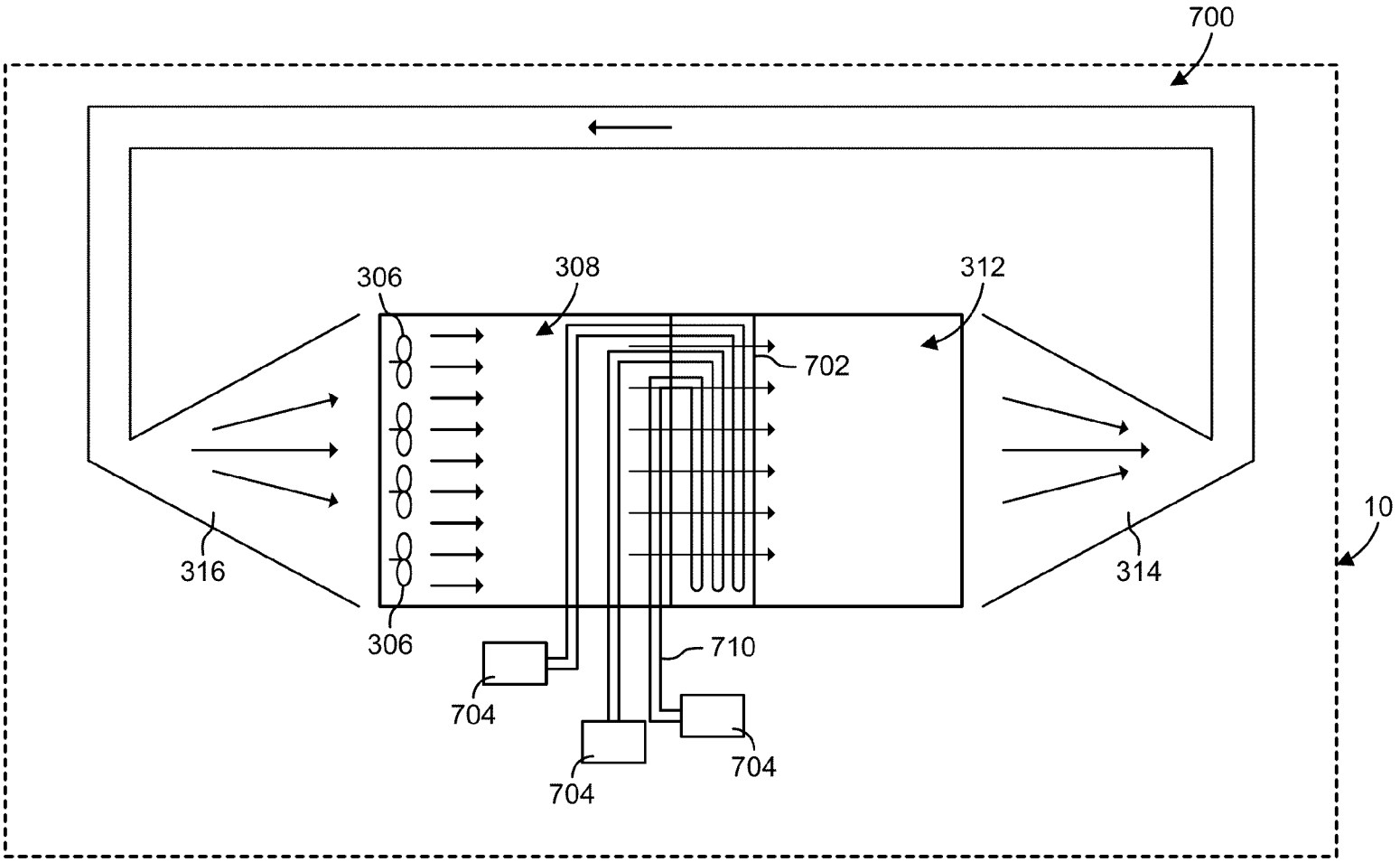
FIG. 7 is a schematic illustration of an air cooling system for the temperature-controlled display case, according to an exemplary embodiment in which the air cooling system includes an evaporator connected to a condensing unit having a plurality of circuits.

Referring now to FIG. 7, a cooling system 700 for controlling the temperature of display device 10 is shown, according to an exemplary embodiment. Cooling system 700 is similar to the cooling systems otherwise described herein and much of the description dedicated to cooling systems 100, 300, 500, and 600 may be applied accordingly to cooling system 700. However, rather than having a plurality of modular cooling elements (as shown in FIGS. 3-6), cooling system 700 includes a single cooling element 702 (e.g., evaporator). Cooling element 702 is connected to a plurality of condensing units 704 and configured to receive liquid coolant from condensing units 704. In the illustrated embodiment of FIG. 7, condensing units 704 are contained within display device 10 or are otherwise local to display device 10, but in other embodiments condensing units 704 are remotely connected to cooling element 702 and configured to supply liquid coolant remotely.

Condensing units 704 are connected to cooling element 702 by one or more fluid lines (e.g., fluid line 710) configured to deliver liquid coolant to cooling element 702. In the illustrated embodiment, each condensing unit 704 includes a single fluid line 710 forming a circuit from condensing unit 704 through cooling element 702, and back to condensing unit 704. In this embodiment, fluid line 710 is configured to deliver liquid coolant to cooling element 702 and return coolant vapor from cooling element 702 to condensing unit 704. Fluid line 710 also runs through cooling element 702 such that liquid coolant may be stored within fluid line 710 at cooling element 702, absorbing heat from and chilling the air surrounding cooling element 702. In this way, portions of fluid line 710 may operate similarly to coils 318 of cooling system 300, providing chilled air for cooling product area 312. Once the coolant is changed to a vapor state within fluid line 710, the coolant may be returned to condensing unit 704.

Similar to cooling systems 300, 500, and 600, cooling system 700 also includes a single air plenum 308 common to each of one or more fans 306 and cooling element 702. Air plenum 308 is configured to direct the air flow from one or more fans 306 over fluid line 710 within cooling element 702, such that cooling element 702 receives air from common air plenum 308. Air plenum 308 may also partially direct the chilled air surrounding cooling element 702 into product area 312 of temperature-controlled display device 10.

The construction and arrangement of the systems and methods as shown in the various exemplary embodiments are illustrative only. Although only a few implementations of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Numerous specific details are described to provide a thorough understanding of the disclosure. However, in certain instances, well-known or conventional details are not described in order to avoid obscuring the description. References to "some embodiments," "one embodiment," "an exemplary embodiment," and/or "various embodiments" in the present disclosure can be, but not necessarily are, references to the same embodiment and such references mean at least one of the embodiments.

Alternative language and synonyms may be used for anyone or more of the terms discussed herein. No special significance should be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

The elements and assemblies may be constructed from any of a wide variety of materials that provide sufficient strength or durability, in any of a wide variety of colors, textures, and combinations. Further, elements shown as integrally formed may be constructed of multiple parts or elements.

As used herein, the word "exemplary" is used to mean serving as an example, instance or illustration. Any implementation or design described herein as "exemplary" is not necessarily to be construed as preferred or advantageous over other implementations or designs. Rather, use of the word exemplary is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary implementations without departing from the scope of the appended claims.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

As used herein, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied.

Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

What is claimed is:

1. An air cooling system for a temperature-controlled display case, the system comprising:

at least two modular cooling elements;

one or more fans configured to provide an air flow to the at least two modular cooling elements; and an air plenum common to each of the one or more fans and the at least two modular cooling elements such that cooling air communicates with the at least two modular cooling elements with the air plenum, the air plenum being configured to direct the air flow from the one or more fans through the at least two modular cooling elements and into a product area of the temperature-controlled display case;

wherein each of the one or more fans and the at least two modular cooling elements are housed within the air plenum.

2. The air cooling system of claim 1, further comprising a condensing system configured to supply an inlet flow of coolant to the at least two modular cooling elements.

3. The air cooling system of claim 2, wherein the condensing system comprises a single condensing unit configured to supply an inlet flow of coolant to each of the at least two modular cooling elements, and wherein the at least two modular cooling elements are arranged in parallel to receive the inlet flow of coolant from the single condensing unit.

4. The air cooling system of claim 2, wherein the condensing system comprises at least two modular condensing units, and wherein each of the modular condensing units is uniquely associated with one of the at least two modular cooling elements and configured to supply an inlet flow of coolant to its associated modular evaporator coil.

5. The air cooling system of claim 4, wherein each of the at least two modular cooling elements is connected to and configured to receive an inlet supply of coolant from only one of the at least two modular condensing units, such that each of the modular condensing units and its associated modular evaporator coil form a modular heat exchange system.

6. The air cooling system of claim 2, wherein the condensing system is provided locally as part of the temperature-controlled display case.

7. The air cooling system of claim 2, wherein the condensing system is remotely connected to the at least two modular cooling elements and configured to remotely provide coolant to the at least two modular cooling elements.

8. The air cooling system of claim 2, further comprising a chiller that is configured to interact with the condensing system to chill the coolant using a secondary coolant provided via a secondary heat exchange system.

9. A temperature-controlled display case, comprising:

a product display area; and an air cooling system configured to provide cooled air to the product display area, the air cooling system comprising:

at least two modular cooling elements;

one or more fans configured to provide an air flow to the at least two modular cooling elements; and an air plenum common to each of the one or more fans and the at least two modular cooling elements such that cooling air communicates with the at least two modular cooling elements with the air plenum, the air plenum being configured to circulate the air flow from the one or more fans through the at least two modular cooling elements and into the product display area.

10. The temperature-controlled display case of claim 9, further comprising a condensing system configured to supply an inlet flow of coolant to the at least two modular cooling elements.

11. The temperature-controlled display case of claim 10, wherein the condensing system comprises a single condensing unit configured to supply an inlet flow of coolant to each of the at least two modular cooling elements, and wherein the at least two modular cooling elements are arranged in parallel to receive the inlet flow of coolant from the single condensing unit.

12. The temperature-controlled display case of claim 10, wherein the condensing system comprises at least two modular condensing units, and wherein each of the modular condensing units is uniquely associated with one of the at least two modular cooling elements and configured to supply an inlet flow of coolant to its associated modular evaporator coil.

13. The temperature-controlled display case of claim 12, wherein each of the at least two modular cooling elements is connected to and configured to receive an inlet supply of coolant from only one of the at least two modular condensing units, such that each of the modular condensing units and its associated modular evaporator coil form a modular heat exchange system.

14. The temperature-controlled display case of claim 10, further comprising a chiller that is configured to interact with the condensing system to chill the coolant using a secondary coolant provided via a secondary heat exchange system.

15. An air cooling system for a temperature-controlled display case, the air cooling system comprising:

an evaporator;

a condensing system having a plurality of fluid circuits routed through the evaporator and being configured to provide an inlet supply of coolant through the evaporator via the plurality of fluid circuits, each of the plurality of fluid circuits comprising a coil;

one or more fans configured to provide an air flow to the coils; and an air plenum common to each of the one or more fans and the coils such that cooling air communicates with the at least two modular cooling elements with the air plenum, the air plenum being configured to circulate the air flow from the one or more fans over the coils and into a product display area of the temperature-controlled display case.

16. The air cooling system of claim 15, wherein the condensing system further comprises a plurality of condensing units configured to provide coolant to the evaporator via at least one of the plurality of fluid circuits.

17. The air cooling system of claim 16, wherein each of the plurality of fluid circuits is connected to and associated with one of the plurality of condensing units, such that each of the fluid circuits provides coolant to the evaporator via a separate condensing unit.

18. The air cooling system of claim 17, wherein each of the plurality of condensing units is connected to only one of the plurality of fluid circuits, such that each of the condensing units and its associated fluid circuit form a modular condensing unit.

19. The air cooling system of claim 15, wherein the condensing system is provided locally as part of the temperature-controlled display case.

20. The air cooling system of claim 15, wherein the condensing system is remotely connected to the evaporator and configured to remotely provide coolant to the evaporator.

* * * * *